US007640630B2

(12) United States Patent
Lee

(10) Patent No.: US 7,640,630 B2
(45) Date of Patent: Jan. 5, 2010

(54) REFRIGERATOR

(75) Inventor: Byung Kil Lee, Gwangju (KR)

(73) Assignee: Samsung Gwangju Electronics Co., Ltd., Gwangsan-gu, Gwangju (KR)

( * ) Notice: Subject to any disclaimer, the term of this patent is extended or adjusted under 35 U.S.C. 154(b) by 0 days.

(21) Appl. No.: 12/107,846

(22) Filed: Apr. 23, 2008

(65) Prior Publication Data

US 2008/0295291 A1 Dec. 4, 2008

(30) Foreign Application Priority Data

May 28, 2007 (KR) ..... 10-2007-0051567

(51) Int. Cl.
*E05B 1/00* (2006.01)

(52) U.S. Cl. ..... 16/413; 16/422; 16/DIG. 24; 312/116

(58) Field of Classification Search ..... 16/412, 16/413, 422, 425, 110.1, DIG. 24, DIG. 41, 16/436, 415; 220/759; 312/405, 348.6, 116; 49/460–461

See application file for complete search history.

(56) References Cited

U.S. PATENT DOCUMENTS 3,995,349 A * 12/1976 Roberts et al. ..... 16/412
5,259,089 A * 11/1993 Baur et al. ..... 16/444
5,493,756 A * 2/1996 Shanok et al. ..... 16/412
6,609,274 B2 * 8/2003 Christensen et al. ..... 16/412
7,197,792 B2 * 4/2007 Moon ..... 16/436
2009/0015124 A1 * 1/2009 Yang ..... 312/405

FOREIGN PATENT DOCUMENTS

KR 1020060014652 A 2/2006

* cited by examiner

*Primary Examiner*—William L. Miller
(74) *Attorney, Agent, or Firm*—Ohlandt, Greeley, Ruggiero & Perle, L.L.P.

(57) ABSTRACT

A refrigerator capable of saving time and labor for mounting a handle to a door is disclosed. The refrigerator has a main body including a storage compartment opened toward the front, a door mounted to the main body to open and close the storage compartment, a handle provided on the front of the door in the form of a long shaft extended lengthwise in a vertical direction of the door in order to open and close the door, and fastening units arranged between the handle and the door lengthwise in the vertical direction of the door to enable mounting of the handle to the door through a simple operation of pushing the handle toward the door and engaging the fastening units.

8 Claims, 10 Drawing Sheets

REFRIGERATOR

CROSS-REFERENCE TO RELATED APPLICATION

This application claims the benefit of Korean Patent Application No. 2007-51567, filed on May 28, 2007, in the Korean Intellectual Property Office, the disclosure of which is incorporated herein by reference.

BACKGROUND OF THE INVENTION

1. Field of the Invention

The present disclosure relates to a refrigerator, and more particularly to an assembling structure between a door which opens and closes a storage compartment of a refrigerator and a handle extended in shaft form in a length direction of the door and mounted on a front of the door, where the assembling structure provides simple and convenient attachment of the handle to the door.

2. Description of the Related Art

Generally, refrigerators are used to preserve contents stored in a storage compartment in a cold or frozen state, by refrigerating the storage compartment formed inside a main body thereof using cool air generated by an evaporator of a refrigeration cycle.

The storage compartment is provided in the main body, as opened toward the front, and the main body has a door at the front thereof to open and close the storage compartment.

The door is hinged upon the main body and opens and closes the storage compartment by pivoting. A handle is formed on the front of the door for a user to conveniently open and close the door.

Generally, the storage compartment is partitioned into a refrigerating compartment and a freezing compartment. Accordingly, a door for the refrigerating compartment and a door for the freezing compartment are separately provided for independent opening and closing between the compartments. Recently, the trend is toward a side-by-side refrigerator in which the refrigerating compartment and the freezing compartment are divided left and right, and the refrigerating compartment door and the freezing compartment door are mounted to the both front sides of the main body in a length direction of the main body.

In some of the above-type refrigerators, the handle for opening and closing the door has a long shaft form extended lengthwise in a vertical direction of the door such that even a child of small stature or a person who is sitting is able to easily hold and operate the door.

More specifically, since the handle is extended lengthwise in a vertical direction corresponding to the length of the door, the handle is mounted by at least two fastening units for a stable connection, keeping a predetermined distance from the door along the length direction.

In general, the fastening units each comprise a first fastening member fixed to the door, a second fastening member fixed to the handle, and a third fastening member fixing the first and second fastening members to each other. The first and second fastening members may be fixed directly to the door and the handle, or through a dedicated screw. The third fastening member usually has the screw form.

In the conventional mounting structure for the refrigerator handle, however, the first and second fastening members are fixed to each other by the third fastening member after being respectively fixed to the door and the handle. Therefore, processes for fastening the third fastening unit are increased according to the number of the fastening units. Furthermore, some operators have to hold the handle and the door while the others are fastening the third fastening member until the plurality of fastening units are all fastened. That is, several operators are required to fasten the handle to the door by the conventional fastening process.

SUMMARY OF THE INVENTION

The present disclosure has been made in order to solve the above problems. It is an aspect of the disclosure to provide a refrigerator capable of saving time and human labor in connecting a handle to a door thereof.

Additional aspects and/or advantages of the disclosure will be set forth in part in the description which follows and, in part, will be obvious from the description, or may be learned by practice of the disclosure.

Consistent with one aspect, an exemplary embodiment of the present disclosure provides a refrigerator comprising a main body including a storage compartment opened toward the front; a door mounted to the main body to open and close the storage compartment; a handle provided on the front of the door in the form of a long shaft extended lengthwise in a vertical direction of the door in order to open and close the door; and a plurality of fastening units arranged between the handle and the door along the length of the door to enable mounting of the handle to the door through a simple operation of pushing the handle toward the door.

The fastening unit may comprise a cap member structured to be hollow and fixed to the handle; a first fastening member comprising a connection part at one end thereof for connection with the door and an insertion part at the other end for insertion in the cap member, and fixed to the door; and a second fastening member formed as a leaf spring and mounted in the cap member to fix the insertion part inserted in the cap member.

The second fastening member may have a substantially annular shape in which a gap between a first end and a second end can be elastically widened, so as to enclose at least a part of an outer circumference of the insertion part, and the insertion part may include a locking groove on the outer circumference thereof to fix and support the second fastening member.

The fastening unit may further comprise a receiving member received in the cap member to enclose the insertion part inserted in the cap member, the second fastening member is mounted to the receiving member to enclose an outer circumference of the receiving member, and the receiving member includes a cut part formed along the outer circumference thereof through a predetermined section corresponding to the second fastening member so that the second fastening member near the first and second ends can contact the insertion part.

The second fastening member comprises a first end and a second end; a supporting part disposed opposite to the first and second ends to be supported by the outer circumference of the receiving member; and bending parts bent several times interconnecting each end of the supporting part with the first and second ends respectively, so that the first and second ends of the second fastening member can be received in the receiving member through the cut part.

The receiving member and the cap member receiving the receiving member may be fixed together to the handle using a securing member, such as a screw.

The receiving member may closely contact an outer surface of the door, and the receiving member and the cap member are formed by injection molding.

A front end part of the insertion part is tapered to have a decreasing outer diameter in a direction of inserting the insertion part.

The cap member includes a tool insertion hole at a position corresponding to the gap between the first and second ends in order to insert a tool into the cap member by widening the gap between the first and second ends.

BRIEF DESCRIPTION OF THE DRAWINGS

These and/or other aspects and advantages of the exemplary embodiments of the disclosure will become apparent and more readily appreciated from the following description of the embodiments, taken in conjunction with the accompanying drawings, of which.

DETAILED DESCRIPTION OF THE PREFERRED EMBODIMENTS

Figure 1:
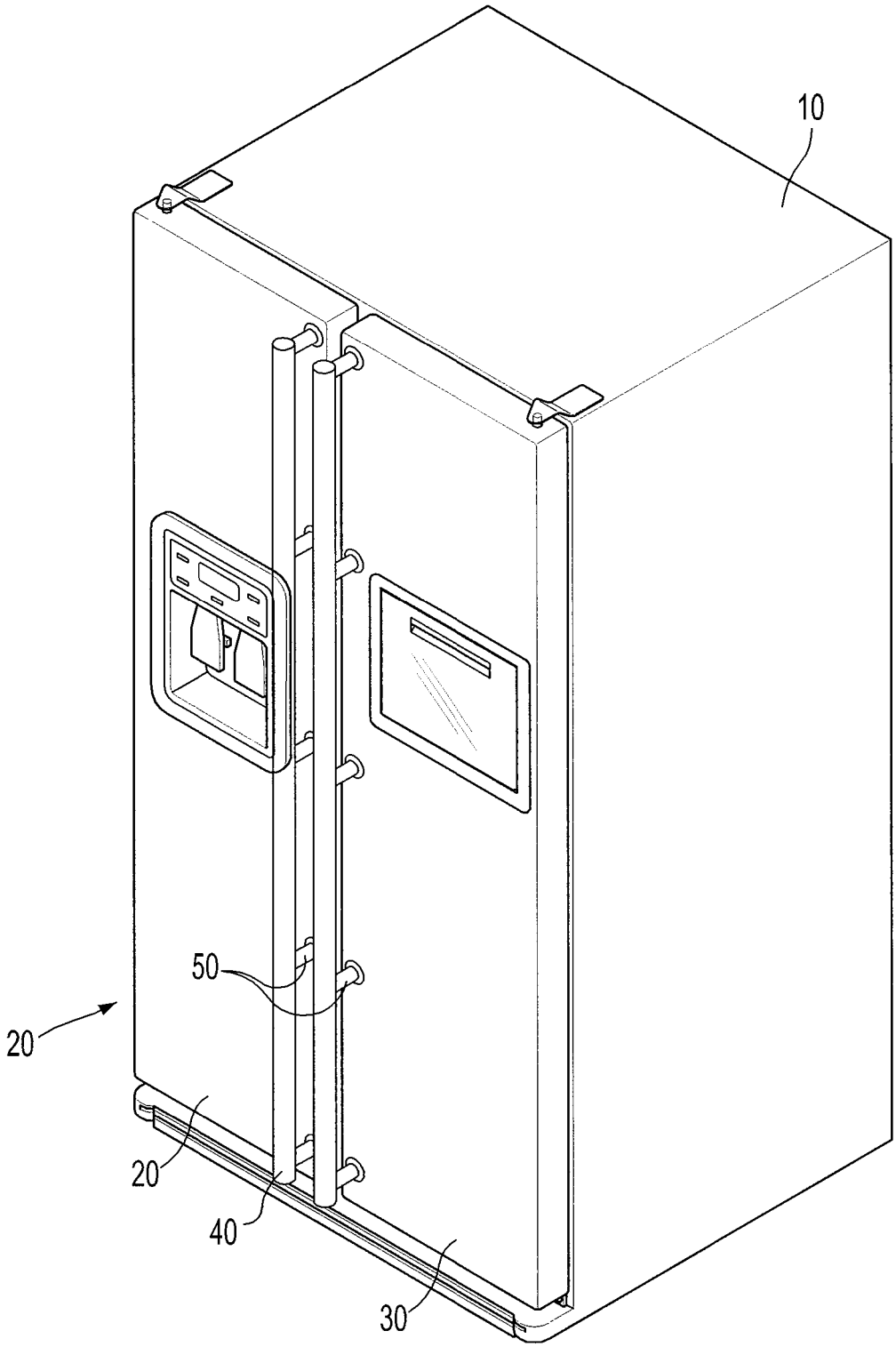
FIG. 1 is a perspective view showing the whole appearance of a refrigerator according to an embodiment of the present disclosure.

Reference will now be made in detail to exemplary embodiments of the present disclosure, examples of which are illustrated in the accompanying drawings, wherein like reference numerals refer to like elements throughout. The embodiments are described below to explain the present disclosure by referring to the figures.

As shown in FIG. 1, a refrigerator according to an embodiment of the present disclosure comprises a main body 10 including a storage compartment (not shown) which is opened to the front, and doors 20 and 30 hinged upon the front of the main body 1 to open and close the storage compartment (not shown) by pivoting.

The storage compartment (not shown) is divided into a freezing compartment on the left and a refrigerating compartment on the right. In one embodiment of doors 20 and 30, for example, door 20 is disposed on the left to open and close the freezing compartment while the other door 30 is disposed on the right to open and close the refrigerating compartment. The doors 20 and 30 are extended in a length direction of the main body 10 and each has a handle 40 for a user to conveniently open and close the doors 20 and 30.

The handle 40 is formed as a hollow shaft extended in corresponding length and direction to the doors 20 and 30 such that even a child of small stature or a person who is sitting is able to easily hold and operate the door.

In order to connect and fix the handle 40 to the fronts of the doors 20 and 30, a fastening unit 50 is provided between the handle 40 and the respective doors 20 and 30. Due to the extended length of the handle 40, a plurality of the fastening units 50 are formed at intervals along the length of the handle 40 so that connection of the handle 40 with the doors 20 and 30 can be more stably achieved. This embodiment employs four fastening units 50.

Figure 2:
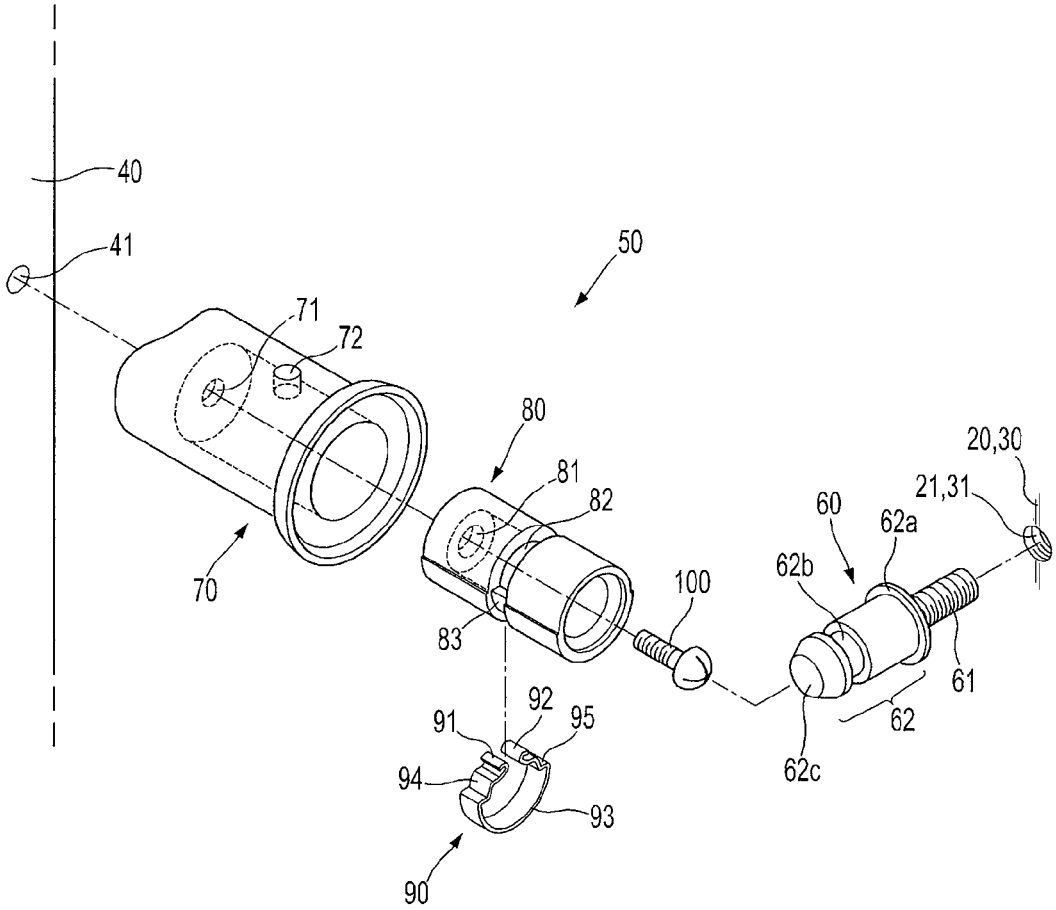
FIG. 2 is an exploded perspective view showing the structure of a fastening unit of the refrigerator according to the embodiment of the present disclosure.
Figure 3:
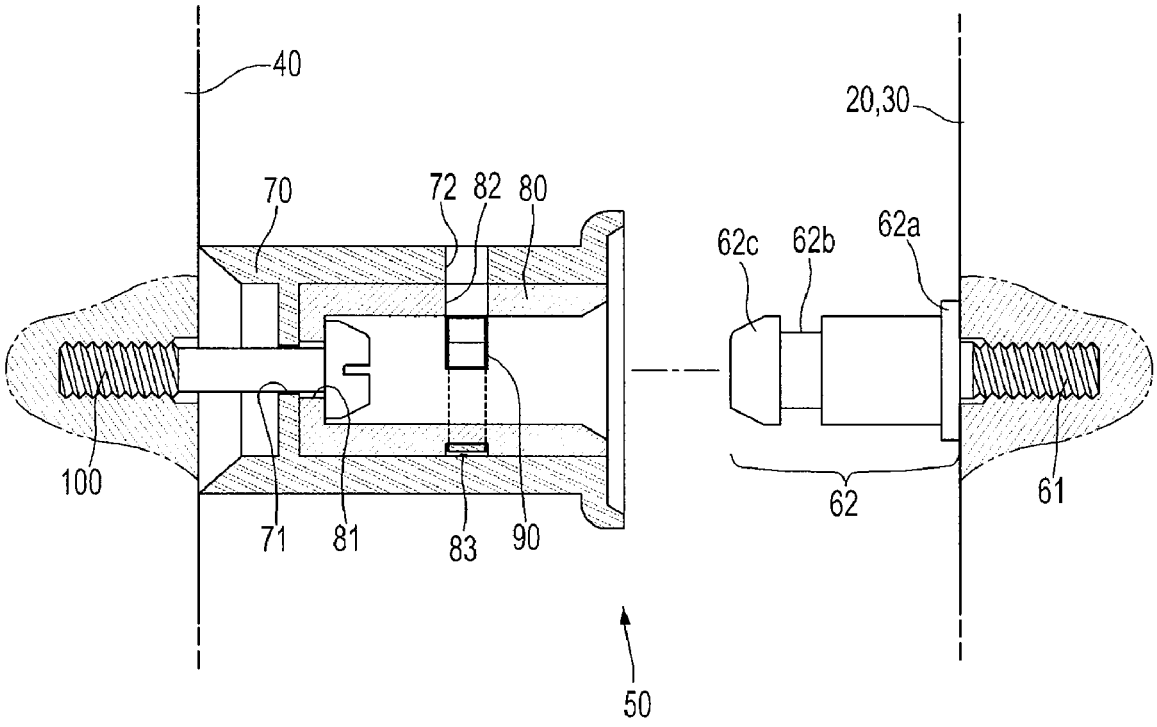
FIG. 3 is a sectional view showing the structure of the fastening unit of the refrigerator according to the embodiment of the present disclosure, in a state before first and second fastening members are connected to each other.

FIG. 2 and FIG. 3 show the structure of the fastening unit 50 in detail.

The fastening unit 50 comprises a first fastening member 60 fixed to the doors 20 and 30, a cap member 70 fixed to the handle 40, and a receiving member 80 and a second fastening member 90 which are mounted within the cap member 70.

The cap member 70 is formed by injection molding in a cylindrical shape which is closed at one end supported by the handle 40 and opened at the other end supported by the doors 20 and 30. A first fastening hole 71 is formed at the closed end of the cap member 70 for connection of a screw 100. The cap member 70 is fixed to the handle 40 by the screw 100. When the fastening unit 50 is completely connected, the other end of the cap member 70, disposed opposite to the first fastening hole 71, is brought into close contact with outer surfaces of the doors 20 and 30.

The first fastening member 60 has a bar shape comprising a connection part 61 formed at one end thereof to be connected with the doors 20 and 30, and an insertion part 62 formed at the other end to be inserted in the cap member 70. Since a screw thread is formed along an outer circumference of the connection part 61, the first fastening member 60 can be screw-connected securely to the front sides of the doors 20 and 30 through the connection part 61. A locking rib 62*a* is formed at a rear end of the insertion part 62 near the connection part 61 so that the first fastening member 60 can be supported by the doors 20 and 30 when connection of the connection part 61 is completed. In addition, a locking groove 62*b* is formed annularly between a front end and the rear end of the insertion part 62 to support the second fastening member 90. A front end part 62*c* of the insertion part 62, formed at a front side of the locking groove 62*b*, is tapered to have a decreasing outer diameter in a direction of inserting the insertion part 62.

The second fastening member 90 is formed as a leaf spring for elastically pushing and restricting the insertion unit 62 of the first fastening member 60 inserted in the cap member 70. The second fastening member 90 is connected with the first fastening member 60. Both the first and second fastening members 60 and 90 are made of metal.

More specifically, the second fastening member 90 has a substantially annular shape in which a gap between both ends thereof, that is, a first end 91 and a second end 92, can be elastically widened. The second fastening member 90 comprises the first and second ends 91 and 92, and a supporting part 93 having a semicircular form disposed opposite to the first and second ends 91 and 92 to be supported in close contact with an outer circumference of the receiving member 80. The second fastening member 90 also comprises a pair of bending parts 94 and 95 connecting an end of the supporting part 93 with the first end 91 and connecting the other end of the supporting part 93 with the second end 92, respectively. The bending parts 94 and 95 each have a zigzag form bent several times in order for easier elastic transformation of the second fastening member 90 transformed to widen the gap between the first end 91 and the second end 92. Also, the bending parts 94 and 95 enable the first and second ends 91 and 92 of the second fastening member 90 to enter the receiving member 80 through a cut part 82 of the receiving member 80.

The second fastening member 90 may be manufactured by bending a linear metal plate. The first and second ends 91 and 92 are bent outward.

The receiving member 80 is received in the cap member 70, thereby reinforcing stiffness of the cap member 70 and helping the second fastening member 90 to be mounted inside the cap member 70.

The receiving member 80 has a form corresponding to the cap member 70. That is, the receiving member 80 is an injection-molded object having a cylindrical form with one end thereof closed and the other end open. The receiving member 80 closely contacts the inside of the cap member 70 by an outer surface thereof while enclosing the insertion part 62 of the first fastening member 60 inserted in the cap member 70. The above-structured receiving member 80 is fixed to the handle 40 along with the cap member 70 through the screw 100. For this, a second fastening hole 81 is formed at the closed end of the receiving member 80 to correspond to the first fastening hole 41.

The second fastening member 90 is mounted to enclose a middle outer circumference of the receiving member 80 with respect to the length direction. Here, the cut part 82 having a semicircular shape is formed at a part of the middle outer circumference enclosed by the second fastening member 90, such that the first and second ends 91 and 92 of the second fastening member 90 contact the insertion part 62 of the first fastening member 60 inserted in the receiving member 80. On the outer circumference of the receiving member 80, a recess 83 is formed at an opposite side to the cut part 82 to receive and stably support the supporting part 93 of the second fastening member 90. According to the above, the gap between the first and second ends 91 and 92 of the second fastening member 90 can be widened by being pushed by the front end part 62*c* of the insertion part 62.

Hereinafter, processes for mounting the handle 40 and the doors 20 and 30 using the fastening unit 50 will be described.

When connecting the handle 40 to the doors 20 and 30 by a plurality of the fastening units 50, first, the first fastening member 60 of each fastening unit 50 is fixed to the fronts of the doors 20 and 30. Here, by rotating the first fastening member 60, the connection part 61 having the screw thread thereon is screw-connected with screw holes 21 and 31 respectively formed on the fronts of the doors 20 and 30.

In the state where the first fastening member 60 of each fastening unit 50 is fixed to the doors 20 and 30, the receiving member 80 mounted with the second fastening member 90 is inserted in the cap member 70 of the fastening unit 50. The second fastening member 90 is fixedly mounted to the outer circumference of the receiving member 80 such that the supporting part 93 is received in the recess 83 and the first and second ends 91 and 92 and the bending parts 94 and 95 can enter the receiving member 80 through the cut part 82. In this state, the cap member 70 along with the receiving member 80 received therein is fixed to the handle 40 by the screw 100 engaged with the first and second fastening holes 71 and 81 within the receiving member 80.

According to FIG. 3, in each fastening unit 50, the first fastening member 60 of the fastening unit 50 is fixed to the doors 20 and 30, and the cap member 70 including the second fastening member 90 and the receiving member 80 therein are fixed to the handle 40.

Figure 4:
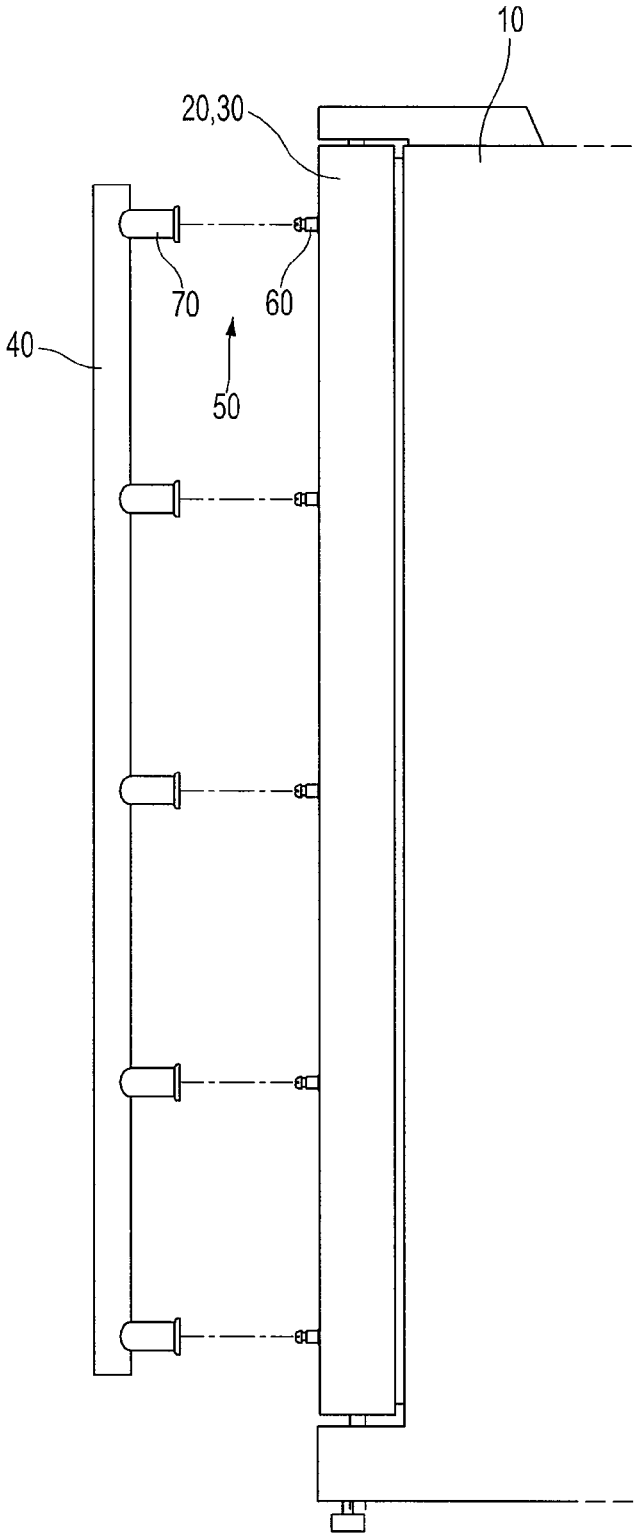
FIG. 4 is a side-sectional view of the refrigerator in which the first fastening member of each fastening unit is fixed to a door and the second fastening member of each fastening unit is fixed to a handle.

In the state of FIG. 3, an operator fits the first fastening member 60 of the fastening unit 50 corresponding to the receiving member 80 received in the cap member 70 in a horizontal direction, and then pushes a handle 40 toward each of the doors 20 and 30, as shown in FIG. 4. In the refrigerator according to the embodiment of the present disclosure, as described above, the first fastening member 60 and the second fastening member 70 of the respective four fastening units 50 can be engaged with each other simply by pushing handle 40 toward each of the doors 20 and 30, thereby mounting handle 40 to each of the doors 20 and 30.

Figure 5:
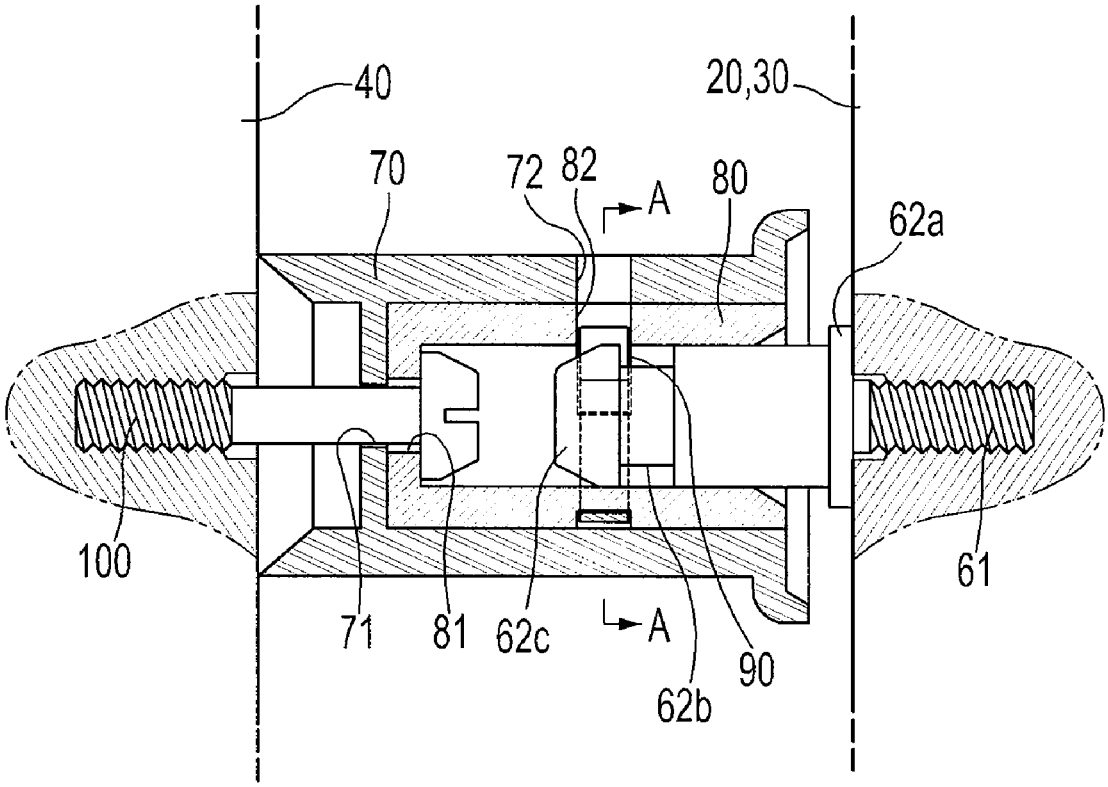
FIG. 5 is a sectional view illustrating connection processes between the handle and the door by the fastening unit in the refrigerator according to the embodiment of the present disclosure, more specifically, where an insertion part of the first fastening member is in contact with the second fastening member.
Figure 6:
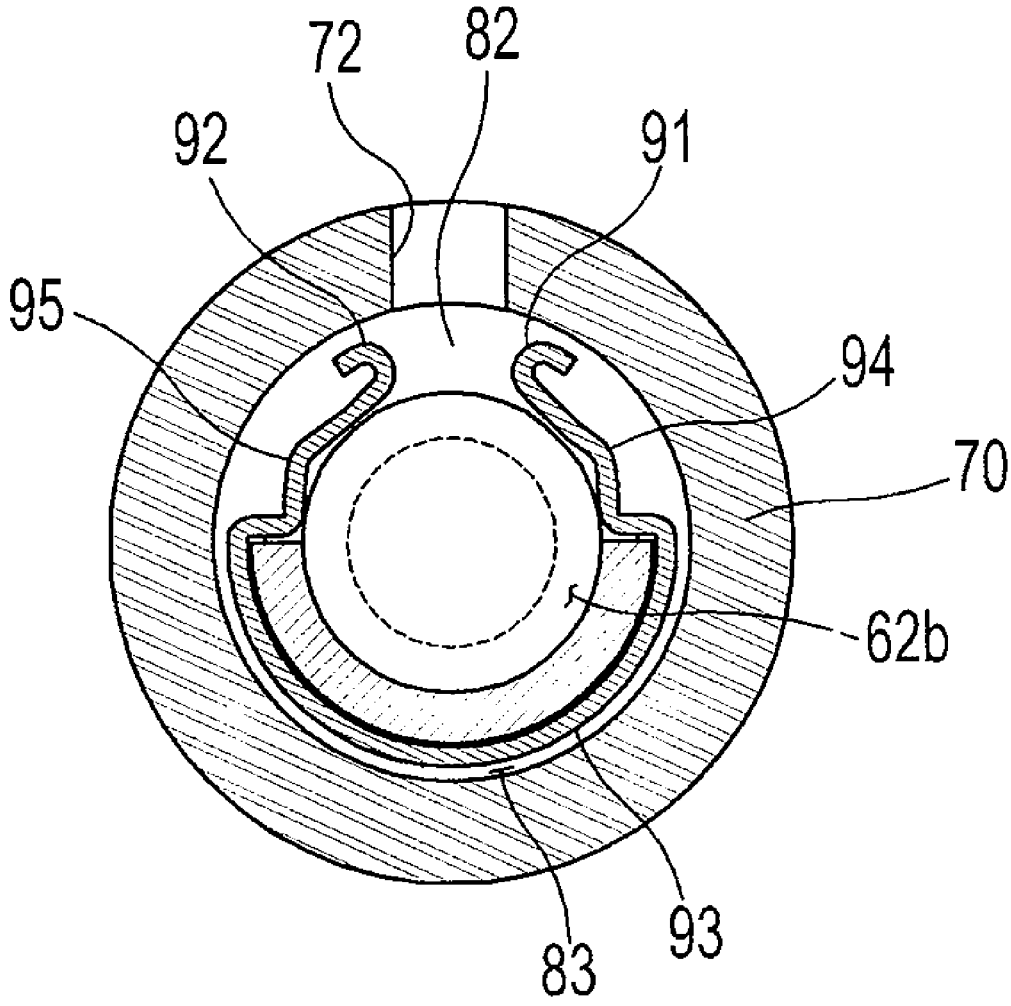
FIG. 6 is a sectional view of FIG. 5 cut along a line A-A and seen from the direction indicated by the arrows.
Figure 7:
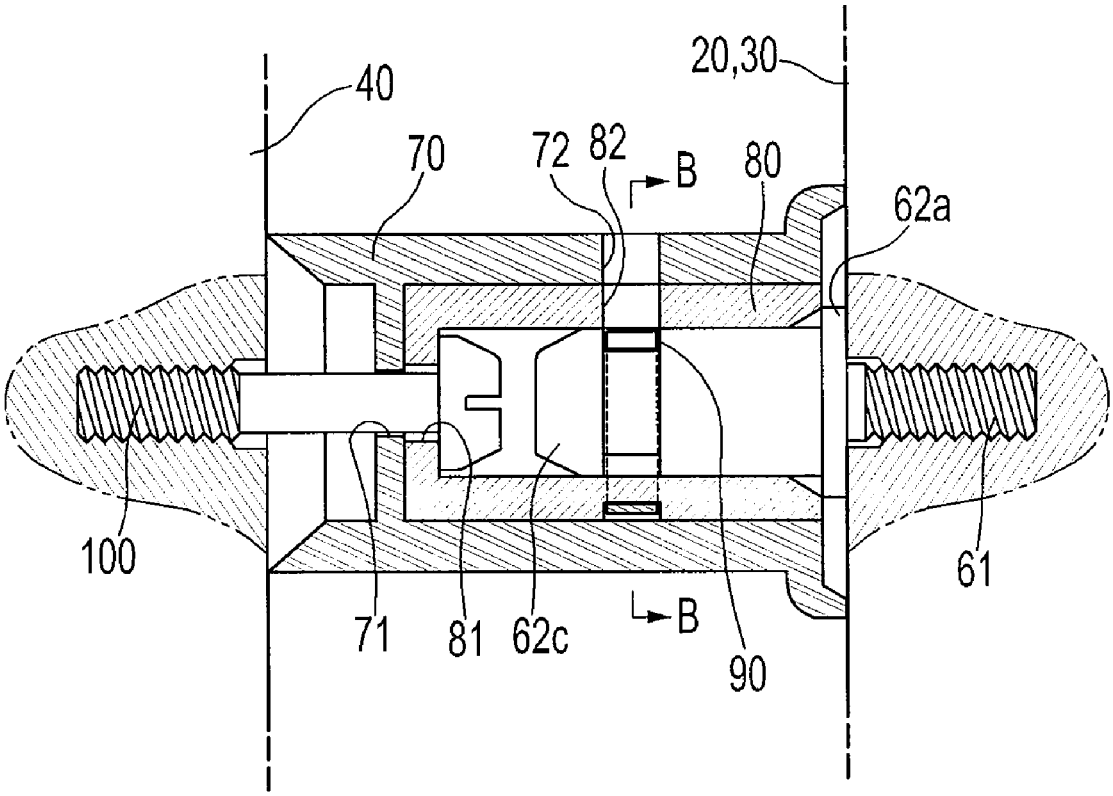
FIG. 7 is a sectional view illustrating the connection processes between the handle and the door by the fastening unit in the refrigerator according to the embodiment of the present disclosure, more specifically, where connection between the first fastening member and the second fastening member is completed.
Figure 8:
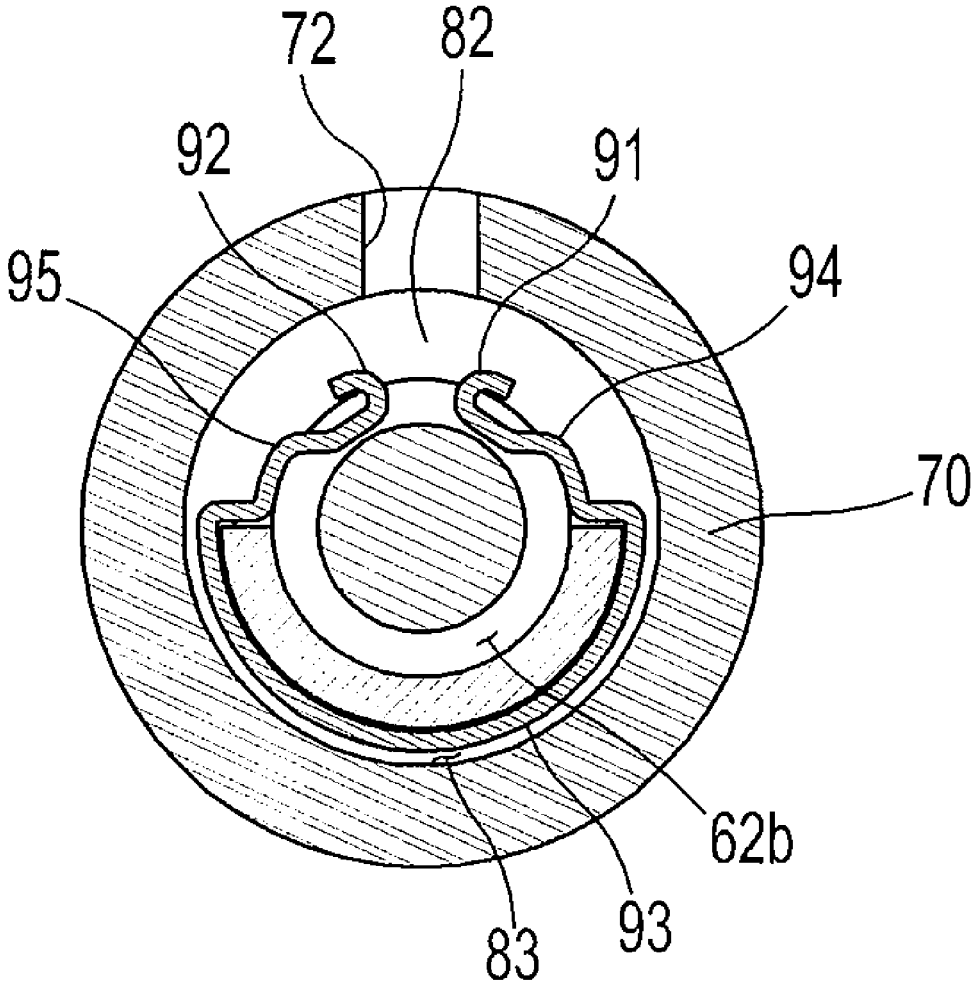
FIG. 8 is a sectional view of FIG. 7 cut along a line B-B and seen from the direction indicated by the arrows.

To be more specific, as shown in FIGS. 5 and 6, by pushing handle 40, the front end part 62*c* of the insertion part 62 of the first fastening member 60 is brought into contact with the first and second ends 91 and 92 of the second fastening member 90 which is inserted in the receiving member 80 through the cut part 82.

During this, the front end part 62*c* of the tapered insertion part 62 widens the gap between the first and second ends 91 and 92, thereby gradually entering the receiving member 80. After the front end part 62*c* of the insertion part 62 penetrates the second fastening member 90, the first and second ends 91 and 92 are restored to the initial position. Accordingly, the second fastening member 90 within the cut part 82 is locked and supported by the locking groove 62*b* of the insertion part 62. As a result, the first fastening member 60 and the second fastening member 90 are engaged with each other and by this, the handle 40 fixed with the second fastening member 90 is connected to the doors 20 and 30 fixed with the first fastening member 60.

Since such connection between the first and second fastening members 60 and 90 can be simultaneously performed at the respective four fastening units 50 by the simple operation of pushing the handle 40 toward the doors 20 and 30, there is no need to fasten the plurality of fastening units 50 individually when mounting the handle 40 to the doors 20 and 30. Accordingly, the handle 40 can be mounted with less time. Furthermore, the mounting of the handle 40 requires just one operator for pushing the handle 40 toward the doors 20 and 30, thereby greatly saving the human labor involved in mounting the handle 40.

In each fastening unit 50, additionally, the cap member 70 includes a tool insertion hole 72 at a position corresponding to the gap between the first and second ends 91 and 92 of the second fastening member 90 in order to permit inserting a tool 200, such as a screwdriver, into the cap member 70.

Figure 9:
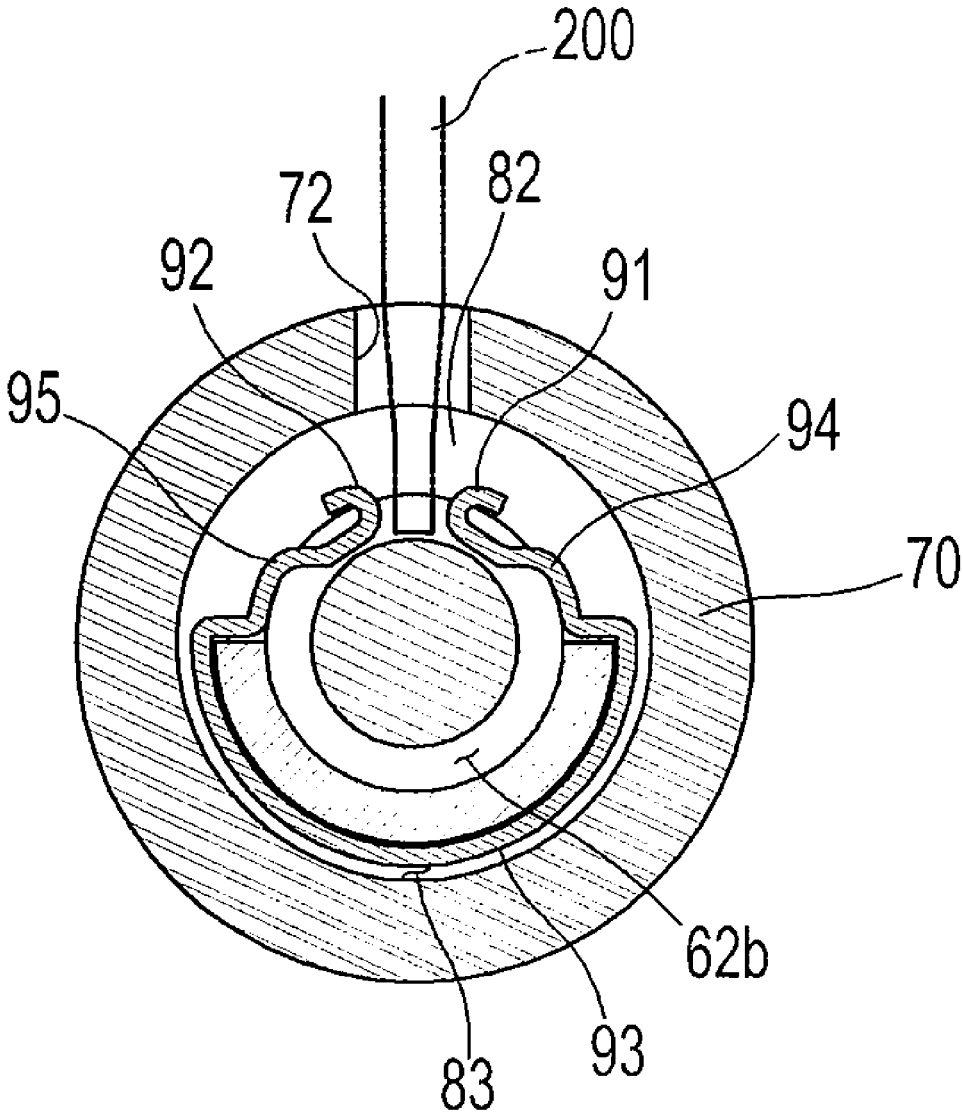
FIG. 9 is a sectional view showing a tool being inserted between first and second ends of the second fastening unit through a tool insertion hole formed at a cap member.
Figure 10:
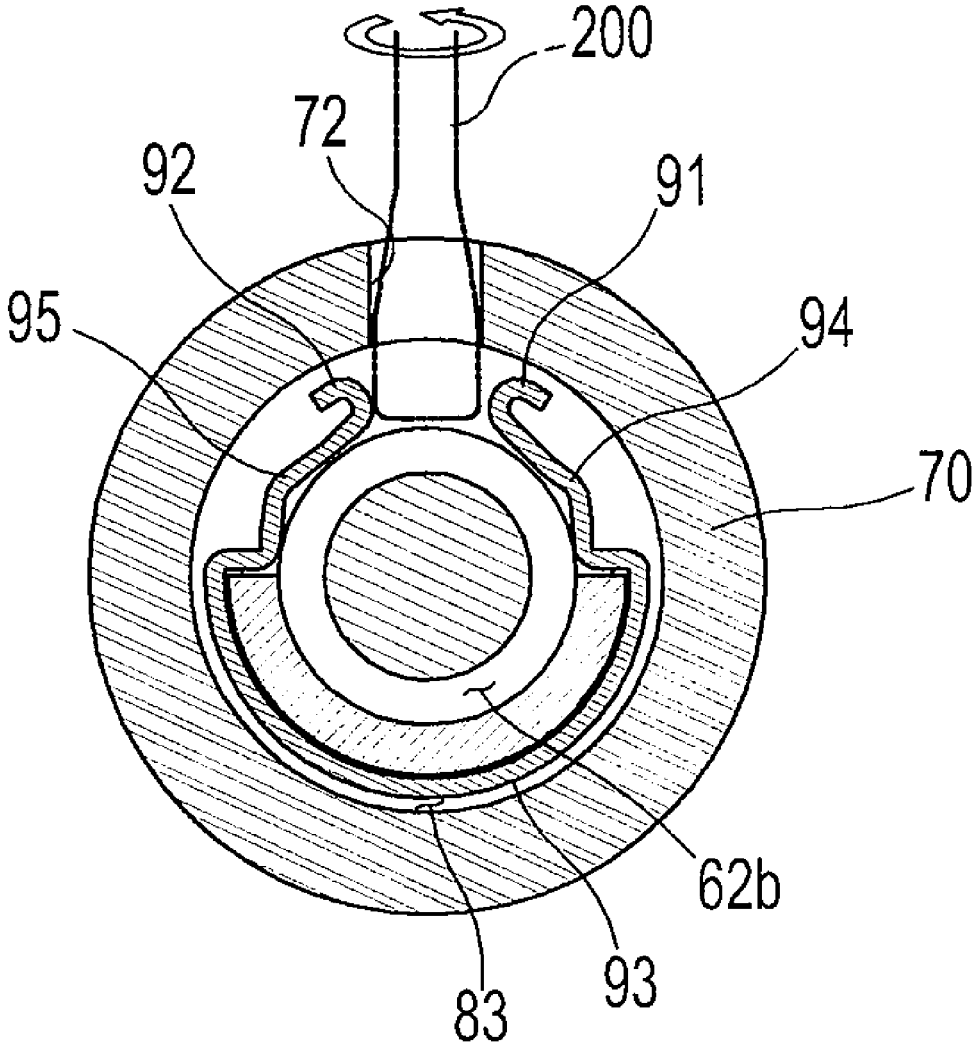
FIG. 10 is a sectional view showing a gap between the first and second ends of the second fastening member being widened by rotating the tool placed as indicated in FIG. 9.

As shown in FIG. 9, a tool insertion hole 72 is provided to insert the tool 200, such as a screwdriver, in the gap between the first and second ends 91 and 92 of the second fastening member 90 within the cap member 70. In the state of FIG. 9, when the operator rotates the tool 200, the gap between the first and second ends 91 and 92 is widened as shown in FIG. 10, thereby releasing the first fastening member 60 from the second fastening member 90. Then, by being pulled forward from the doors 20 and 30, the handle 40 can be separated from the doors 20 and 30 with ease. That is, in the refrigerator according to the embodiment of the present disclosure, separation of the handle 40 from the doors 20 and 40 is also convenient.

In addition, in the refrigerator according to the embodiment of the present disclosure, both the cap member 70 and the receiving member 80 of the fastening unit 50 are formed by injection molding. Therefore, although a leakage current may occur at the main body 10 and flow to the doors 20 and 30 and the first fastening member 60, the injection-molded receiving member 80 and cap member 70 are able to stop the leakage current from flowing to the handle 40.

As can be appreciated from the above description, owing to the plurality of fastening units provided to the refrigerator according to the present disclosure, mounting of a handle to a door can be performed simply by pushing the handle toward the door. Therefore, the present disclosure provides for a saving in human labor as well as time for mounting the handle.

Although embodiments of the present disclosure have been shown and described, it can be appreciated by those skilled in the art that changes may be made in this embodiment without departing from the principles and spirit of the disclosure, the scope of which is defined in the claims and their equivalents.

What is claimed is:

1. A refrigerator comprising:

a main body including a storage compartment opened toward the front;

a door mounted to the main body to open and close the storage compartment;

a handle provided on the front of the door in the form of a long shaft extended lengthwise in a vertical direction of the door in order to open and close the door; and a plurality of fastening units arranged between the handle and the door along the length of the door, wherein each of said plurality of fastening units comprises: a cap member that is hollow and fixed to the handle; a first fastening member comprising a connection part at one end for connection with the door and an insertion part at the other end for insertion in the cap member and fixed to the door; and a second fastening member formed as a leaf spring and mounted in the cap member to fix the insertion part when the insertion part is inserted in the cap member, wherein the handle is mounted to the door by pushing the handle toward the door and engaging the plurality of fastening units.

2. The refrigerator according to claim 1, wherein the second fastening member comprises a first end and a second end, and has a substantially annular shape in which a gap between the first end and the second end can be elastically widened, so as to enclose at least a part of an outer circumference of the insertion part, and the insertion part includes a locking groove on the outer circumference thereof to fix and support the second fastening member.

3. The refrigerator according to claim 2, wherein the fastening unit further comprises a receiving member received in the cap member to enclose the insertion part when the insertion part is inserted in the cap member, the second fastening member is mounted to the receiving member to enclose an outer circumference of the receiving member, and the receiving member includes a cut part formed along the outer circumference thereof through a predetermined section corresponding to the second fastening member so that the second fastening member near the first and second ends can contact the insertion part.

4. The refrigerator according to claim 3, wherein the second fastening member further comprises:

a supporting part disposed opposite to the first and second ends to be supported by the outer circumference of the receiving member; and bending parts bent several times interconnecting each end of the supporting part with the first end and second end respectively, so that the first end and second end of the second fastening member can be received in the receiving member through the cut part.

5. The refrigerator according to claim 3, wherein the receiving member and the cap member receiving the receiving member are fixed together to the handle using a securing member.

6. The refrigerator according to claim 3, wherein the receiving member closely contacts the cap member by an outer surface of the receiving member, and the receiving member and the cap member are formed by injection molding.

7. The refrigerator according to claim 2, wherein a front end part of the insertion part is tapered to have a decreasing outer diameter in a direction of inserting the insertion part.

8. The refrigerator according to claim 2, wherein the cap member further comprises a tool insertion hole at a position corresponding to the gap between the first end and second end of the second fastening member, wherein the tool insertion hole permits insertion of a tool into the cap member to widen the gap between the first end and second end.

* * * * *